US006170710B1

(12) United States Patent
Suffa

(10) Patent No.: US 6,170,710 B1
(45) Date of Patent: Jan. 9, 2001

(54) CLOSURE HAVING A RECESSED GRIP FORMED BY A DEPRESSIBLE PART

(75) Inventor: Udo Suffa, Gefell (DE)

(73) Assignee: Zeller Plastik GmbH, Zell/Mosel (DE)

( * ) Notice: Under 35 U.S.C. 154(b), the term of this patent shall be extended for 0 days.

(21) Appl. No.: 09/011,946

(22) PCT Filed: Aug. 23, 1996

(86) PCT No.: PCT/EP96/03728

§ 371 Date: May 11, 1998

§ 102(e) Date: May 11, 1998

(87) PCT Pub. No.: WO97/08074

PCT Pub. Date: Mar. 6, 1997

(30) Foreign Application Priority Data

Aug. 25, 1995 (DE) ..... 195 31 341

(51) Int. Cl.[7] ..... B67B 5/00
(52) U.S. Cl. ..... 222/153.06; 222/546
(58) Field of Search ..... 222/153.06, 546, 222/556, 153.14; 215/216

(56) References Cited

U.S. PATENT DOCUMENTS 4,821,898 * 4/1989 Smalley ..... 215/216
4,940,167 7/1990 Fillmore et al. ..... 222/153

FOREIGN PATENT DOCUMENTS 0 379 775 * 1/1990 (EP) .
0 379 775 A1 8/1990 (EP) .
2 628 716 * 3/1988 (FR) .
2 628 716 9/1989 (FR) .
1 442 216 7/1976 (GB) .

* cited by examiner

*Primary Examiner*—Gregory L. Huson
(74) *Attorney, Agent, or Firm*—Woodcock Washburn Kurtz Mackiewicz & Norris LLP

(57) ABSTRACT

A closure consisting of a lid and a body is provided, wherein part of the body can be depressed radially, be fixed in the depressed state and forms a recessed grip. The fixation of part 3 can be permanent and undetachable and can thus render a closure tamper proof by indicating that a closure is opened for the first time. Furthermore, an indicator plate, which breaks away when the depressible part is depressed, can additionally render a closure tamper proof. Furthermore, the depressible part can return to its original position after the lid is lifted so that when closing the lid again, the closure cannot be opened before the depressible part is depressed again. In this embodiment an indicator plate arranged on the depressible part renders the closure tamper proof, and, furthermore, the return of the depressed part into the original position renders the closure child proof.

17 Claims, 5 Drawing Sheets

CLOSURE HAVING A RECESSED GRIP FORMED BY A DEPRESSIBLE PART

The invention relates to a closure consisting of a body and a lid having a recessed grip for opening a closure. The recessed grip allows the lid to be gripped from below, to be lifted of the body and thus the opening of the closure.

Closures having recessed grips for opening are already known from the prior art. These recessed grips are either arranged as recesses under the lid in the body of the closure or in the lid of the closure. It is also known to disengage a locking between a lid and a body by elastically depressing a body, wherein the body returns to its original position.

In contrast to that, it is an object of the invention to provide a closure having a recessed grip for opening, which ensures an easy lifting of the lid from the closure, and which preferably at the same time renders the closure tamper proof by indicating that the closure is opened for the first time.

In achieving the object, the invention is based on the following basic ideas.

Part of the closure body can be depressed radially and fixed or locked in the depressed state. In this way a recessed grip is formed under the closure lid allowing an easy lifting of the lid. The lid can be opened only after depression of the part.

In a first embodiment of the invention, the depressed part permanently and undetachably engages with the closure body, thus indicating that the closure is opened for the first time.

In a further embodiment of the invention, prior to the first opening an indicator plate which preferably partly surrounds the outer surface of the closure lid is provided on the depressible part. When depressing the part the indicator plate breaks away and it is thus additionally indicated that the closure is opened for the first time.

In a further embodiment of the invention, the lock-in position for the depressible part is located in the lid and, prior to the first opening, an indicator plate is, as already described, provided on the depressible part. When depressing the part, the indicator plate breaks away and the depressible part engages with the closure lid. When opening the lid the depressible part returns to its original position, so that it is again flush with the lid when the closure is closed. Repeatedly opening the closure by lifting the lid is only possible by repeatedly depressing the depressible part. In this way the closure is rendered child proof, wherein the indicator plate, however, guarantees that the closure is tamper proof.

The advantages of the invention reside in an easy handling and an improved tamper indication of the closure.

In the following the invention will be described in more detail in connection with the drawings in which FIG. 1 shows a cross-sectional view of an embodiment of the invention prior to the first opening of the closure lid;

FIG. 2 shows the embodiment according to FIG. 1 of the invention with a recessed grip;

FIG. 3*a* shows an enlarged sectional view of the embodiment according to FIG. 1 of the invention;

FIG. 3*b* shows a top view of the embodiment according to FIG. 3*a* of the invention with lifted lid;

FIG. 4*a* shows an enlarged sectional view of the embodiment according to FIG. 2 of the invention, FIG. 4*b* shows a top view of the embodiment according to FIG. 4*a* of the invention with lifted lid;

Figure 7:
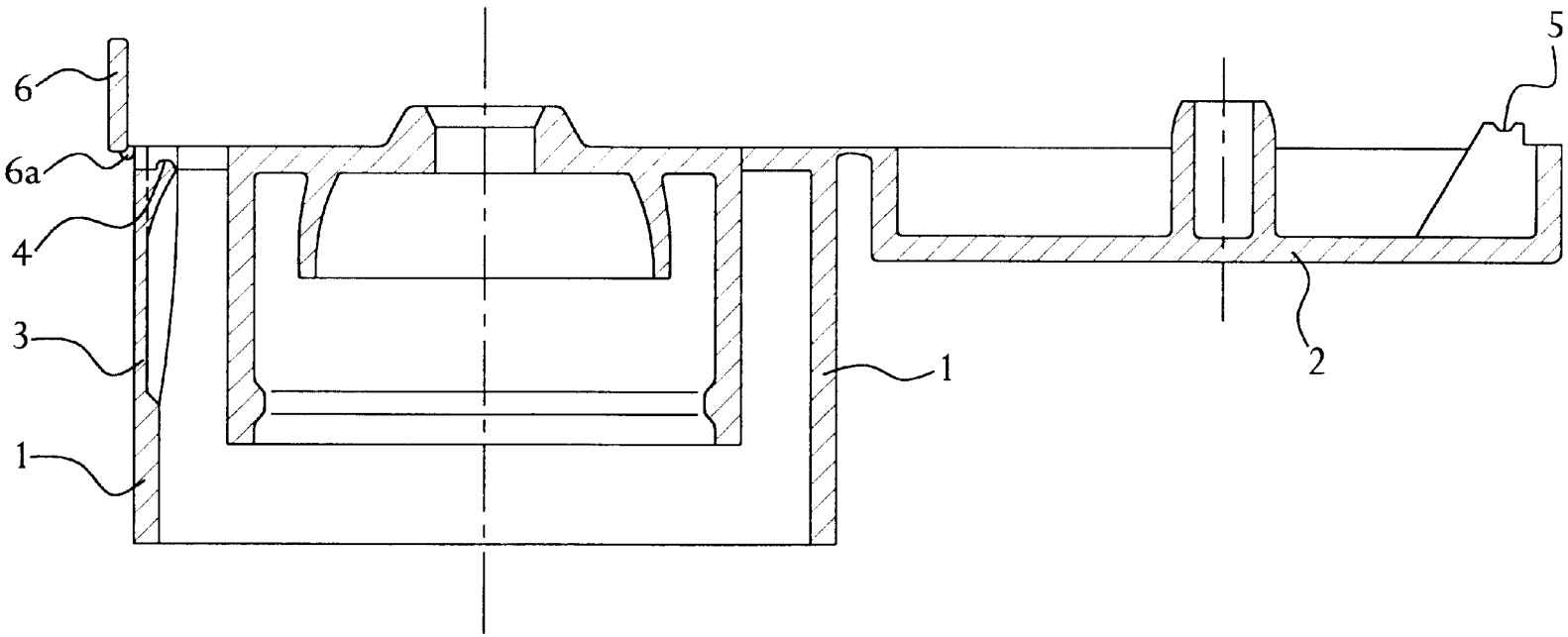
FIG. 7 shows a cross-sectional view of a further embodiment of the invention in the production state after removal from the injection mold.
Figure 8A:
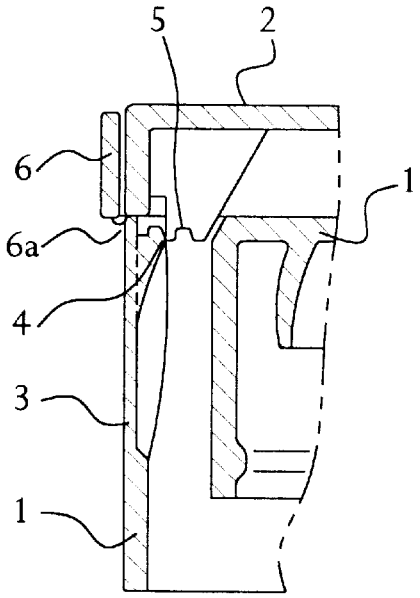
Figure 8B:
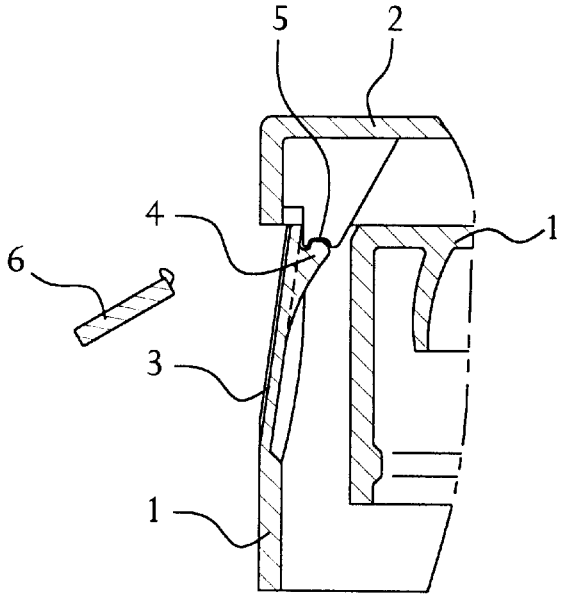
Figure 8C:
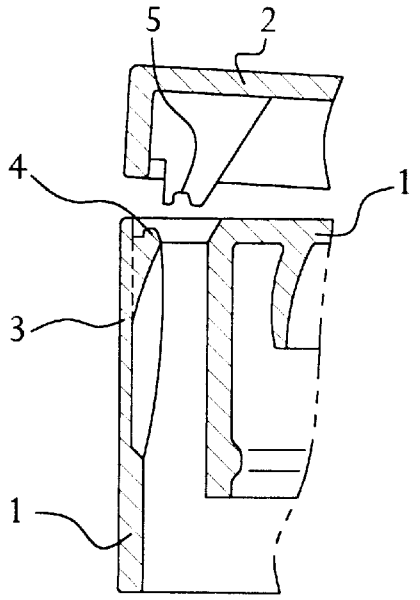
Figure 8D:
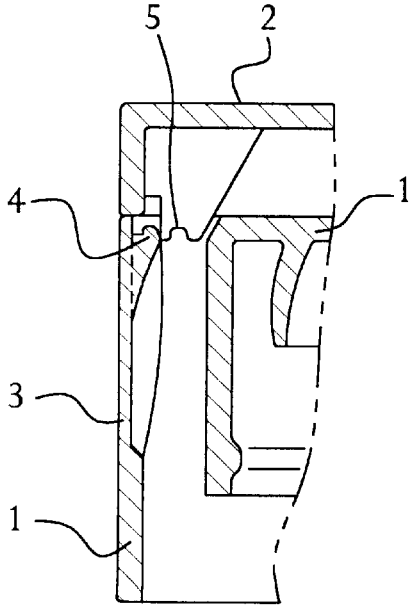

FIG. 8*a* shows a sectional view of the embodiment according to FIG. 7 of the invention in the area of the recessed grip prior to the first opening;

FIG. 8*b* shows the embodiment according to FIG. 8*a* of the invention after formation of the recessed grip;

FIG. 8*c* shows the embodiment according to FIG. 8*b* of the invention after lifting the lid; and FIG. 8*d* shows the embodiment according to FIG. 8*c* of the invention after closing the lid again.

Figure 1:
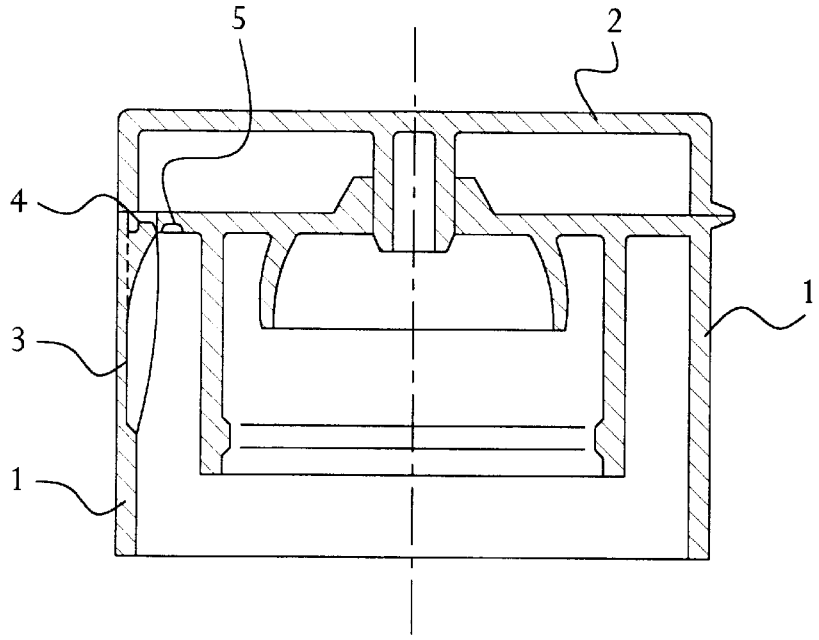

FIG. 1 shows a first embodiment of the invention with the closure being in the closed state. A depressible part 3 being flush with the closure lid 2 is provided on the closure body 1. The depressible part 3 has a projection 4, and the closure body 1 is provided with a recess 5 which may engage (lock) with the projection 4 when part 3 is depressed. The depressible part 3 is part of the wall of the body 1 and is preferably reduced in thickness with respect to that wall, and the outer surface of it is structured or dyed to ensure an easier and localized depression. Moreover, part 3 is preferably elastic.

Figure 2:
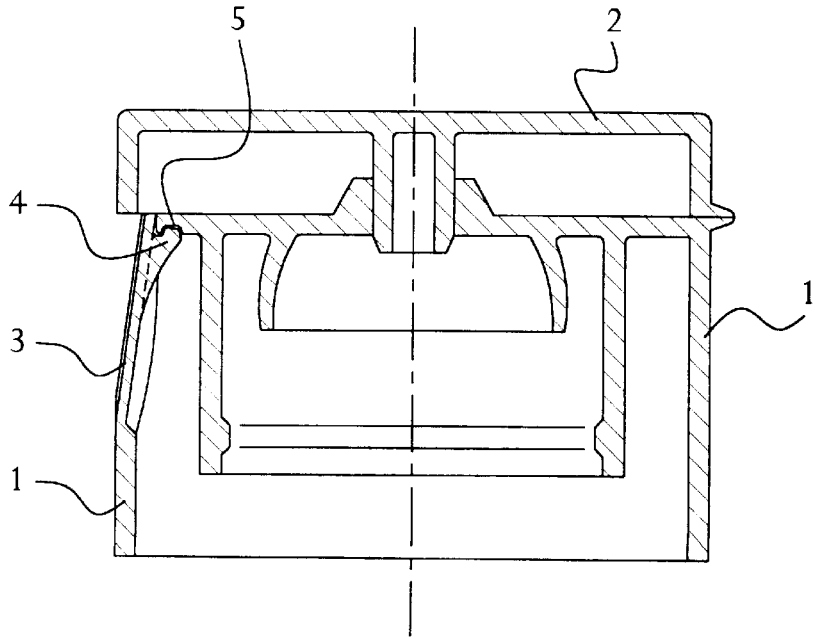

FIG. 2 shows part 3 in the depressed state. For this, part 3 having a reduced thickness was moved radially inwardly, e.g. by pressure of the finger, until it engages with projection 4 in the recess 5. After that, lid 2 which could until now not be lifted, can now easily be lifted, e.g. by pressure of the finger, and the closure can be opened. In this embodiment, after the first operation of the closure, the recessed grip is formed permanently and undetachably. After closing again, the recessed grip thus indicates that it had already been opened. Since the closure cannot be opened before depression of part 3, the recessed grip thus renders the closure tamper proof.

Figure 3A:
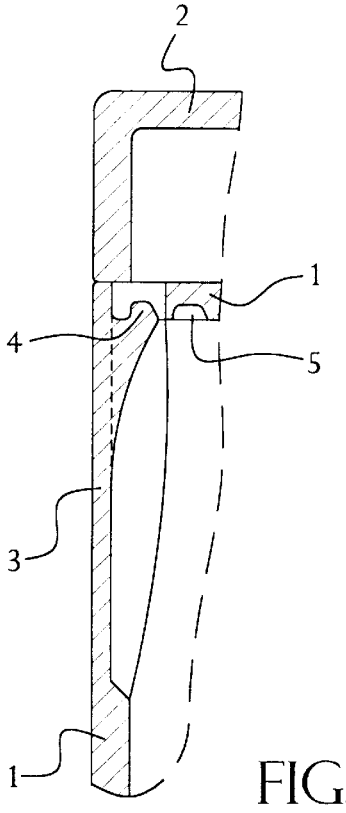
Figure 4A:
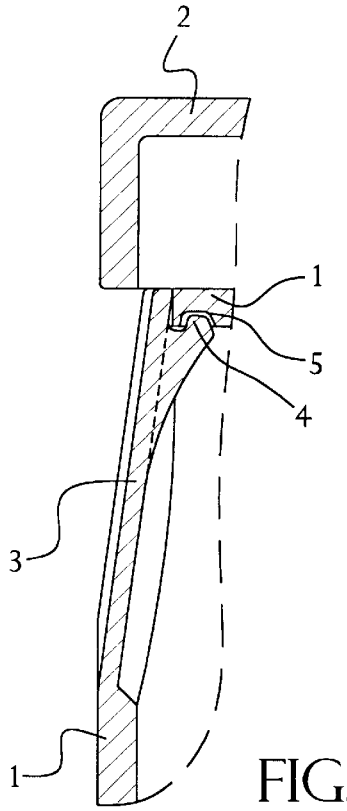
Figure 3B:
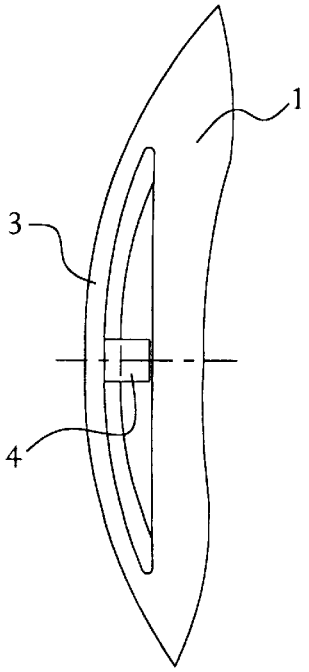
Figure 4B:
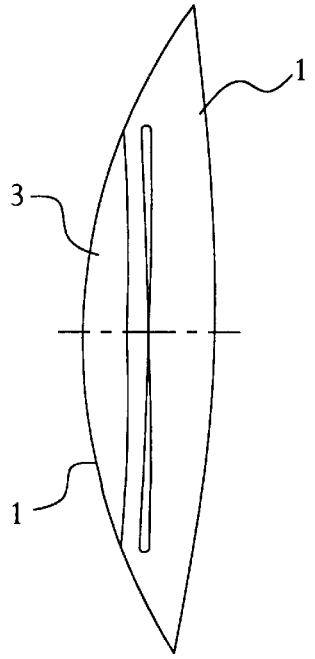

FIGS. 3*a* and 4*a* are enlarged views of the areas of the recessed grips of FIGS. 1 and 2, respectively. FIG. 3*b* is a top view of FIG. 3*a* after lifting lid 2, and FIG. 4*b* is a top view of the embodiment according to FIG. 4*a* with lid 2 being lifted. In the embodiment according to FIGS. 3*b* and 4*b* part 3 is part of a convex wall of the closure body 1. The depressible part of the recessed grip can, however, also be part of a concave or non-curved wall of a closure body.

Figure 5:
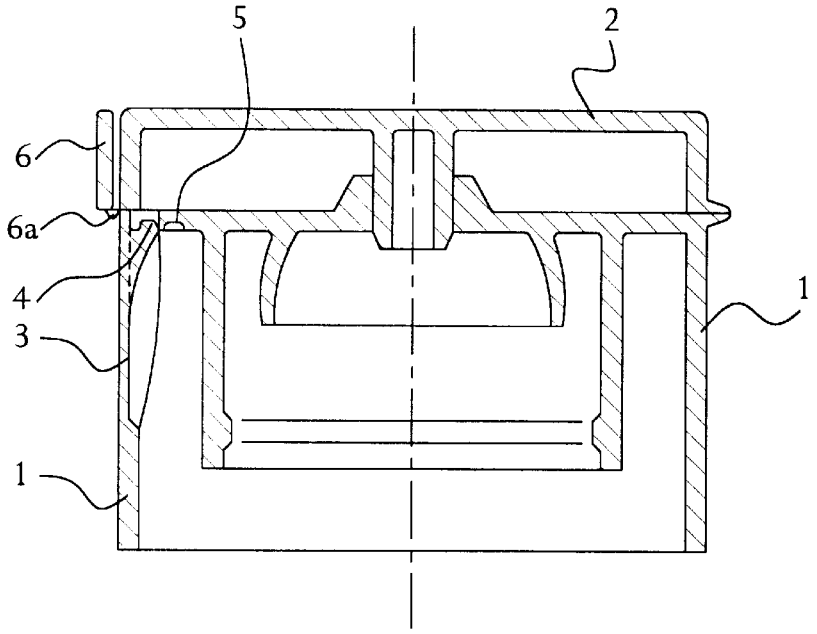
FIG. 5 shows a cross-sectional view of a further embodiment of the invention prior to the first opening of the closure.

FIG. 5 shows a further embodiment of the invention prior to the first opening of the closure, wherein an indicator plate 6 is provided, which is arranged at the depressible part 3 via at least one predetermined breaking point 6*a* and partly surrounds the exterior of lid 2.

Figure 6:
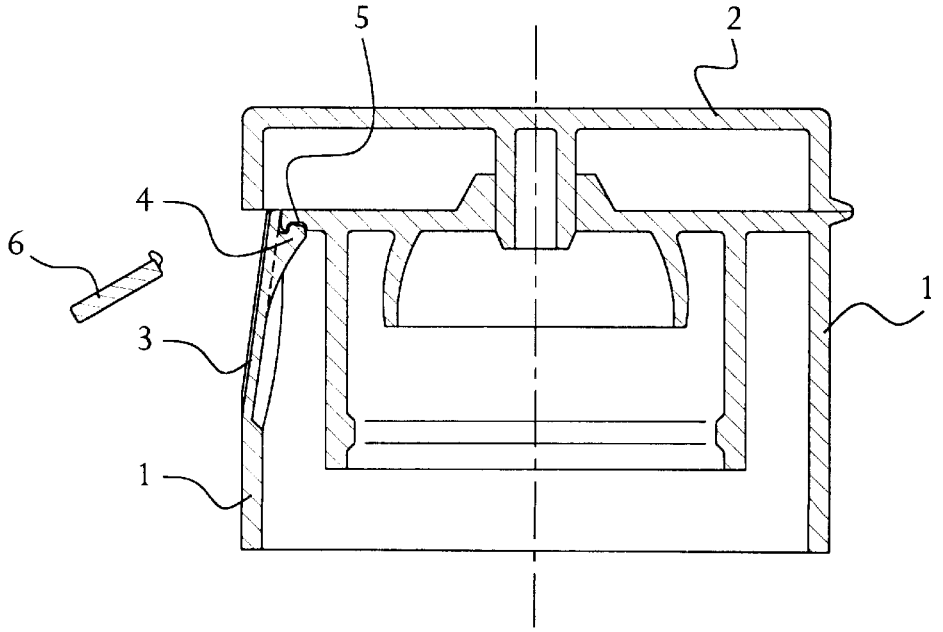
FIG. 6 shows the embodiment according to FIG. 5 of the invention with recessed grip.

FIG. 6 shows the embodiment according to FIG. 5 of the invention after depression of part 3. The indicator plate 6 was thereby sheared off by lid 2. Like in the embodiment according to FIGS. 1 to 4*b*, the depressible part permanently and undetachably locks with projection 4 in the recess 5 of the body 1 and thus forms the recessed grip for lifting lid 2. The indicator plate 6 additionally renders the closure tamper proof.

FIG. 7 shows a further embodiment of the invention in the production state with the lid being lifted. In this embodiment the recess 5 is provided in the lid 2. The depressible part 3 has an indicator plate 6.

FIG. 8*a* shows a sectional view of the embodiment according to FIG. 7 in the closed state of the closure prior to the first opening.

FIG. 8*b* shows the recessed grip after depressing part 3. Projection 4 thereby engages with recess 5 of lid 2, and the indicator plate 6 was sheared off by lid 2 when depressing part 3. In contrast to the embodiments according to FIGS. 1 to 6 of the invention, in this embodiment the recessed grip is not formed permanently and undetachably, since when lifting lid 2 recess 5 is lifted from projection 4.

FIG. 8*c* shows the embodiment according to FIG. 8*b* after lifting lid 2. The elastically formed part 3 returns to its original position after unlocking projection 4 and recess 5.

After closing the lid again, as shown in FIG. 8*d*, part 3 becomes again flush with lid 2. In this position lid 2 cannot be lifted and can only be lifted of body 1 after part 3 is again depressed and projection 4 engages with recess 5.

In this way, even after the first use an unintended opening of the closure by unauthorized persons, e.g. children, is prevented and, in addition to being tamper proof due to the provision of the indicator plate 6, the closure is also rendered child proof.

The recessed grip according to the invention can be made of plastics, preferably polypropylene, and can be used in combination with a container for, e.g., toilet articles, household cleaning agents and related products or pharmaceutical products.

I claim:

1. A closure for use with a container, comprising a body substantially affixed relative to the container and a lid, the body including a depressible part formed in the body and depressible relative to the body, a portion of the body proximate the depressed part forming a recessed grip in the body, the body having a depressed state and a flush state, the depressible part radially inwardly depressed and fixed to form the recessed grip for opening the lid in the depressed state, the depressible part flush with the lid in the flush state, the recessed grip formed below the lid and recessed relative thereto to facilitate opening of the lid.

2. The closure according to claim 1, wherein the depressible part is elastic.

3. The closure according to claim 1, wherein at least one recess is formed in one of the body and the lid, the depressible part including at least one projection formed thereon and projecting radially inwardly therefrom, the at least one projection engageable in the at least one recess to form the recessed grip.

4. The closure according to claim 3, wherein the at least one recess is provided on the body, the at least one projection undetachably engaging the at least one recess to permanently lock the depressible part in the depressed state in response to an initial depressing of the depressible part from the flush state to the depressed state.

5. The closure according to claim 3, wherein the at least one recess is provided on the lid.

6. The closure according to claim 1, wherein the depressible part is reduced in thickness with respect to the body.

7. The closure according to claim 1, wherein the depressible part is flush with the lid in the flush state.

8. The closure according to claim 1, wherein the body includes an indicator plate frangibly coupled thereto, the indicator plate permanently breakable from the body upon an initial depressing of the depressible part from the flush state to the depressed state, whereby the indicator plate is broken from the body upon the initial depressing to indicate that the lid had previously been opened.

9. The closure according to claim 5, wherein the projection is spaced apart from the recess in the flush state, the projection detachably engaging the at least one recess in response to depressing the depressible part to form the recessed grip, the depressible part returning from the depressed state to its original position in the flush state in response to opening of the lid.

10. The closure according to claim 1, wherein the exterior surface of the depressible part is structured or dyed.

11. The closure according to claim 1, wherein the closure is produced of polypropylene.

12. Use of the closure according to claim 1 in connection with a container for toilet articles, household cleaning agents and related products or pharmaceutical products.

13. The closure according to claim 1, wherein the closure consists essentially of the body and the lid.

14. The closure according to claim 1, wherein the depressible part substantially forms a chordal side of the body wall in the depressed state.

15. A closure for use with a container, comprising a body substantially affixed to the container and a lid having a peripheral outer rim, the body including a body wall and a recess formed in the body, the body wall being disposed below the lid outer rim and having a depressible part that has an inwardly extending projection formed thereon, the depressible part being depressible within a space formed in the body from a flush state in which the body wall is circular to a depressed state in which the depressible part is inwardly deformed from a circular shape, the depressible part being flush with the lid outer rim and the projection being spaced apart from the recess in the flush state, the projection undetachably engaging the recess to lock the depressible part radially inwardly to form a recessed grip in the depressed state, the recessed grip formed below the lid outer rim to facilitate opening of the lid, whereby the recessed grip is permanently deformed in response to an initial depressing of the depressible part to indicate that the closure had previously been opened.

16. The closure according to claim 15, wherein the body includes an indicator plate frangibly coupled thereto, the indicator plate permanently breakable from the body upon the initial depressing of the depressible part from the flush state to the depressed state, whereby the indicator plate is broken from the body upon the initial depressing to indicate that the lid had previously been opened.

17. A closure for use with a container, comprising a body substantially affixed to the container and a lid having a peripheral outer rim and a recess formed therein, the body including a body wall being disposed below the lid outer rim and having a depressible part that has an inwardly extending projection formed thereon, the depressible part being movable within a space formed in the body between a flush state in which the body wall is circular and a depressed state in which the depressible part is inwardly deformed from a circular shape, the depressible part being flush with the lid outer rim and the projection being spaced apart from the recess in the flush state, the projection detachably engaging the recess to radially inwardly engage the depressible part to form a recessed grip in the depressed state, the recessed grip formed below the lid outer rim to facilitate opening of the lid, the projection detachable from the recess in response to opening of the lid, the projection being engaged in the recess to hold the depressible part in the depressed state until the outer rim of the lid is forced upward via the recessed grip, whereby the depressible part moves radially outward to the flush state in response to opening of the lid to make opening the lid more difficult for a child.

* * * * *